US008901444B2

(12) United States Patent
Ho et al.

(10) Patent No.: US 8,901,444 B2
(45) Date of Patent: Dec. 2, 2014

(54) CURRENT SWITCHING DEVICE AND METHOD FOR MANUFACTURING THE SAME

(75) Inventors: Ying-Sung Ho, Taoyuan (TW); Ta-Feng Yeh, Taoyuan (TW); Yao-Chung Tsai, Taoyuan (TW)

(73) Assignee: Solteam Electronics Co., Ltd. (TW)

( * ) Notice: Subject to any disclaimer, the term of this patent is extended or adjusted under 35 U.S.C. 154(b) by 881 days.

(21) Appl. No.: 13/009,030

(22) Filed: Jan. 19, 2011

(65) Prior Publication Data

US 2012/0181154 A1 Jul. 19, 2012

(51) Int. Cl.

| | |
|---|---|
| ***H01H 3/20*** | (2006.01) |
| ***H01H 15/00*** | (2006.01) |
| ***H01H 11/00*** | (2006.01) |
| ***H01H 21/30*** | (2006.01) |
| ***H01H 1/44*** | (2006.01) |
| *H01H 1/20* | (2006.01) |

(52) U.S. Cl.

CPC ..... *H01H 11/0056* (2013.01); *H01H 2231/048* (2013.01); *H01H 1/2025* (2013.01); *H01H 21/30* (2013.01); *H01H 1/44* (2013.01)

USPC ..... 200/332; 200/335; 200/553

(58) Field of Classification Search

USPC ..... 200/332, 335, 339, 553, 562, 563

See application file for complete search history.

(56) References Cited

U.S. PATENT DOCUMENTS

| | | | | |
|---|---|---|---|---|
| 3,225,156 | A * | 12/1965 | Sahrbacker | 200/5 B |
| 6,642,459 | B2 * | 11/2003 | Chou et al. | 200/11 TW |
| 6,680,444 | B1 * | 1/2004 | Lee | 200/4 |
| 7,102,091 | B2 * | 9/2006 | Miyata et al. | 200/302.2 |

* cited by examiner

*Primary Examiner* — Renee Luebke
*Assistant Examiner* — Lheiren Mae A Caroc

(57) ABSTRACT

The present invention discloses a current switching device and a method for manufacturing the same. The current switching device comprises a cover, a base, a plurality of metal terminals, a switching element, and at least two contact pieces; the base and the cover are combined with each other to form an accommodating space; the plurality of metal terminals are arranged in an asymmetrical shape and buried in the base; the switching element is disposed in the accommodating space; the two contact pieces are disposed on the switching element and comprises at least two contact points respectively, wherein all the contact points contact different metal terminals, and then each contact piece can conduct electricity between two metal terminals; the contact positions between the two contact pieces and the plurality of metal terminals can be changed by the rotary swing of the switching element, so as to switch the current direction.

6 Claims, 11 Drawing Sheets

CURRENT SWITCHING DEVICE AND METHOD FOR MANUFACTURING THE SAME

BACKGROUND OF THE INVENTION

1. Field of the Invention

The present invention relates to a current switching device and a method for manufacturing the same, and more particularly to a current switching device which can used for switching current direction by operating a switching element with a rotary swing manner and a method for manufacturing the same.

2. Description of the Prior Art

Generally, a portable machine tool has advantages of convenience in carrying and easy operation. Owing to some portable machine tools must possess the function of switching running direction at any time for handling every kind of working conditions, it is necessary to design specific driving manners for achieving the purpose. One of the driving manners is to provide a current switching device for switching the running direction of the portable machine tool. The working principle of the current switching device is to reversely switch the input current and the output current of the portable machine tool, so as to repeatedly change the running direction of the portable machine tool.

Referring to FIG. 1, which is an exploded view of a conventional current switching device. The conventional current switching device A includes a base A100, a cover (not shown) and a switching element A200. The base A100 is made of plastic material, and there are four metal terminals A300 buried in the base A100. The four metal terminals A300 are arranged in a manner of partial circular symmetry, and the four metal terminals A300 are metal sheets with equal thickness and with the same plane. Furthermore, a pivot A110 is disposed on the base A100, and the pivot A110 is located on the relative center of the four metal terminals A300. The pivot A110 is provided to pivotally connect with the switching element A200, so that the switching element A200 can rotate around the pivot A110. Furthermore, two sets of contact piece A400 are disposed on the switching element A200 where the four metal terminals A300 are adjacent to, and each set of contact piece A400 can conduct neighboring two metal terminals A300. By way of the rotation of the switching element A200, the manner of the contact pieces A400 conducting electricity in the metal terminals A300 can be changed, so that the current direction can be altered and the effect of switching the running direction of the portable machine tool can be accomplished eventually.

In the above conventional current switching device, owing to the switching element A200 is disposed on the base A100 and can rotate 360 degrees, the configuration of the switching element A200 is usually a cylinder, and an accommodating space of the base A100 for accommodating the switching element A200 is also designed as an cylindrical recess, so that the switching element A200 can rotate smoothly. However, such a design occupies the most space of the base A100, and there is no more space can be utilized in the base A100, thus the overall volume can not easily be reduced and the functions can not easily be expanded.

Moreover, owing to the volume of the conventional current switching device A can not easily be reduced, and the dimension of the cylindrical design of the switching element A200 also can not easily be decreased, the material cost will be wasted.

In view of this, it is necessary to provide a novel current switching device, which can utilize the inner space much effectively, and the cost of material and manufacturing cost can be saved.

SUMMARY OF THE INVENTION

In view of the above shortcomings of the prior art, the inventor of the present invention resorted to past experience, imagination, and creativity, performed experiments and researches repeatedly, and eventually devised the present invention, a current switching device and a method for manufacturing the same.

The major objective of the present invention is to provide the current switching device, by way of improving the structure of the components and the design of the inner space, the utility rate of the inner space can be effectively saved, so as to save the cost of the material and manufacturing.

According to the above objective, the present invention provides the current switching device comprising: a cover being provided with a curved slot; a base being combined with the cover to form an accommodating space, wherein a pivot is disposed on the base and in the accommodating space, and a position of the pivot being corresponding to the center of the curved slot of the cover; a plurality of metal terminals being plate-like structure, the plurality of metal terminals being arranged in an asymmetrical shape and buried in the base, and each of the plurality of metal terminals exposing at least one surface to the accommodating space, wherein a part of the exposed surface of at least one of the metal terminals is formed into a sunken area, and the sunken area being covered by the material of the base and then hidden when the metal terminal being buried in the base, so as to increase the stability of the integration between the metal terminal and the base; a switching element being disposed in the accommodating space and comprising: a switching element body; an axial hole being disposed on the switching element body and pivotally connected to the pivot of the base, so that the switching element body is able to rotate and swing through the pivot; a lever being disposed on the surface of the switching element body adjacent to the cover, the lever penetrating through the curved slot and being exposed to the outside of the current switching device, wherein the lever is able to be pushed for operating the rotary swing of the switching element body; and at least two accommodating slots being disposed on the surface of the switching element body adjacent to the plurality of metal terminals; and at least two contact pieces being disposed in the two accommodating slots respectively, and each contact piece comprising at least two contact points, wherein all the contact points contact different metal terminals, and each contact piece being able to conduct electricity between two metal terminals, the contact positions between the two contact pieces and the plurality of metal terminals being able to be changed by the rotary swing of the switching element, so as to switch the current direction.

Another objective of the present invention is to provide the method for manufacturing the current switching device, by way of injecting plastic material around the plurality of metal terminals and on the sunken area thereof to form the base, the extent of integration between the metal terminals and the base can be increased, therefore the metal terminals can not easily get loose from the base, and the overall stability can be elevated.

According to the above objective, the present invention provides the method for manufacturing a current switching device comprising the steps of: (1) forming a plurality of metal terminals by a stamping manner, wherein the plurality of metal terminals are connected to each other by at least one side strip, and a part of surface of at least one metal terminal being formed into a sunken area; (2) transfer the plurality of metal terminals into a plastic injection mold; (3) injecting plastic material into the plastic injection mold and around the plurality of metal terminals, and the plastic material covering and hiding the sunken area of the plurality of metal terminals; (4) removing the side strip; (5) providing a switching element and at least two contact pieces, combining the switching element and the two contact pieces, and disposing the switching element and the two contact pieces on the base; and (6) providing a cover and disposing the cover on the base.

BRIEF DESCRIPTION OF THE DRAWINGS

For a complete understanding of the aspects, structures and techniques of the invention, reference should be made to the following detailed description and accompanying drawings wherein.

DETAILED DESCRIPTION OF THE PREFERRED EMBODIMENTS

To achieve the foregoing objectives and effects, the inventors design the structure of a switching element and other components with the concept of rotary swing, thus achieving a current switching device and a method for manufacturing the same of the present invention.

Figure 1:
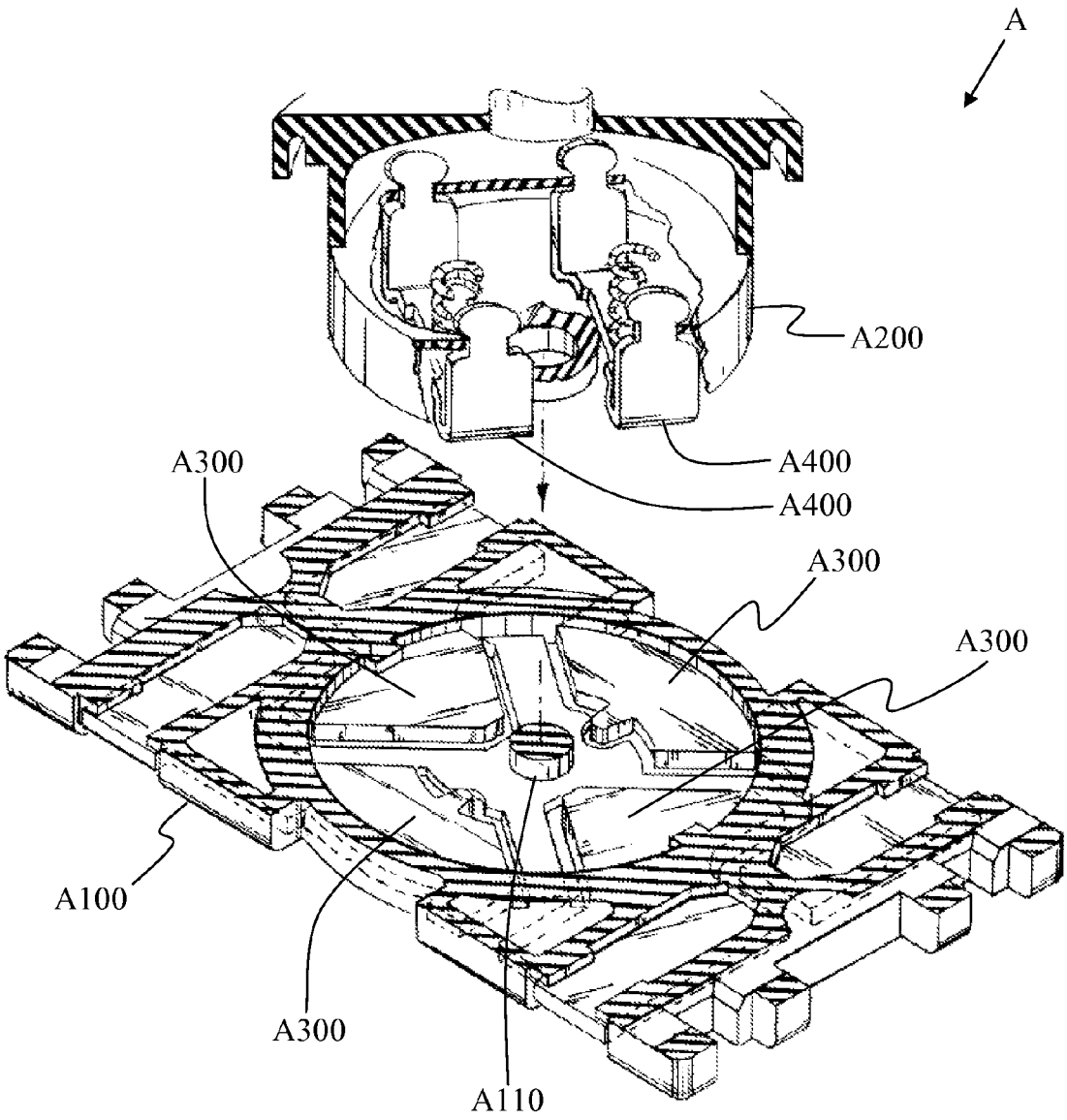
FIG. 1 is an exploded view of a conventional current switching device.
Figure 2:
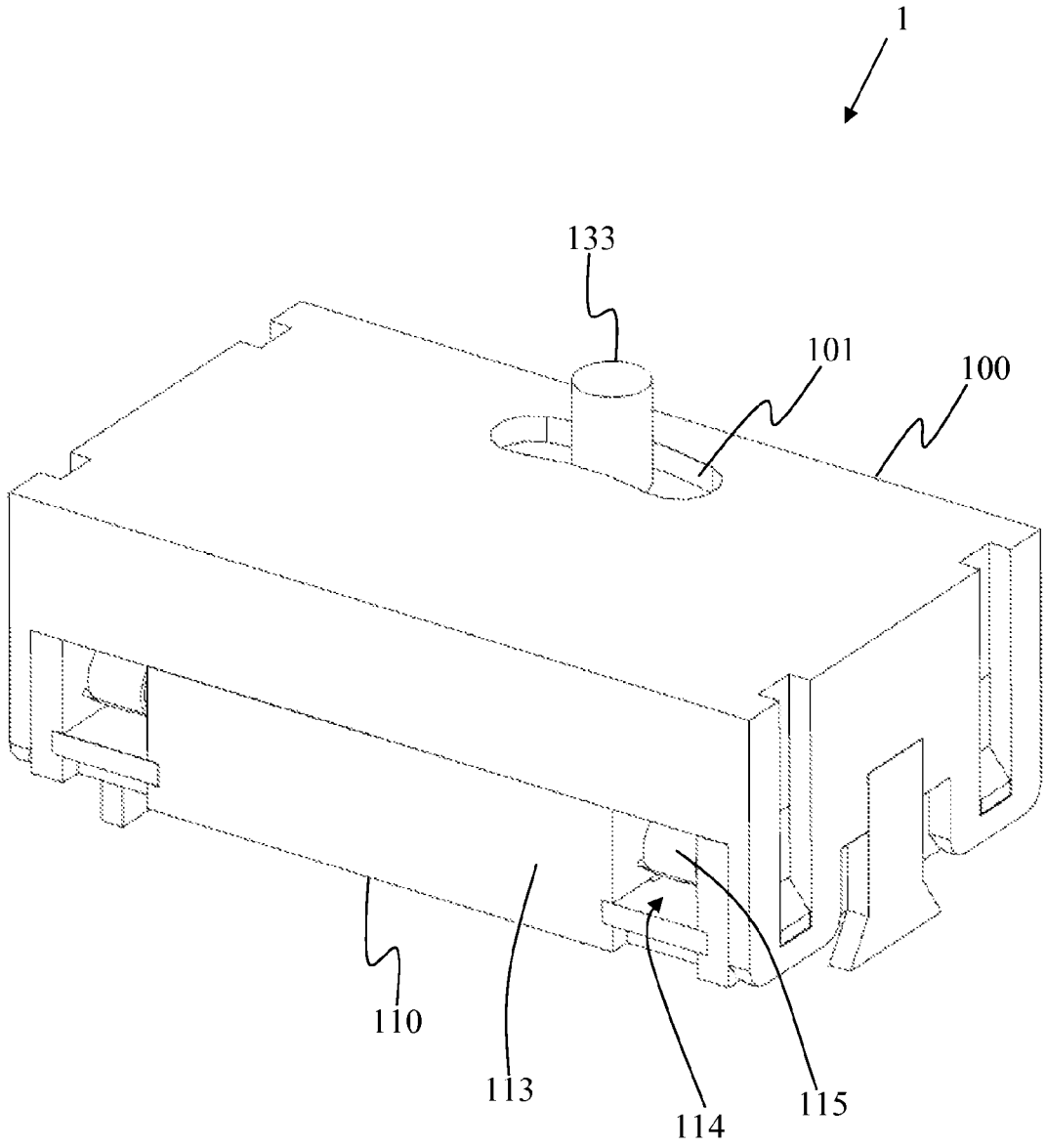
FIG. 2 is an assembly drawing of a current switching device according to a preferred embodiment of the present invention.
Figure 3:
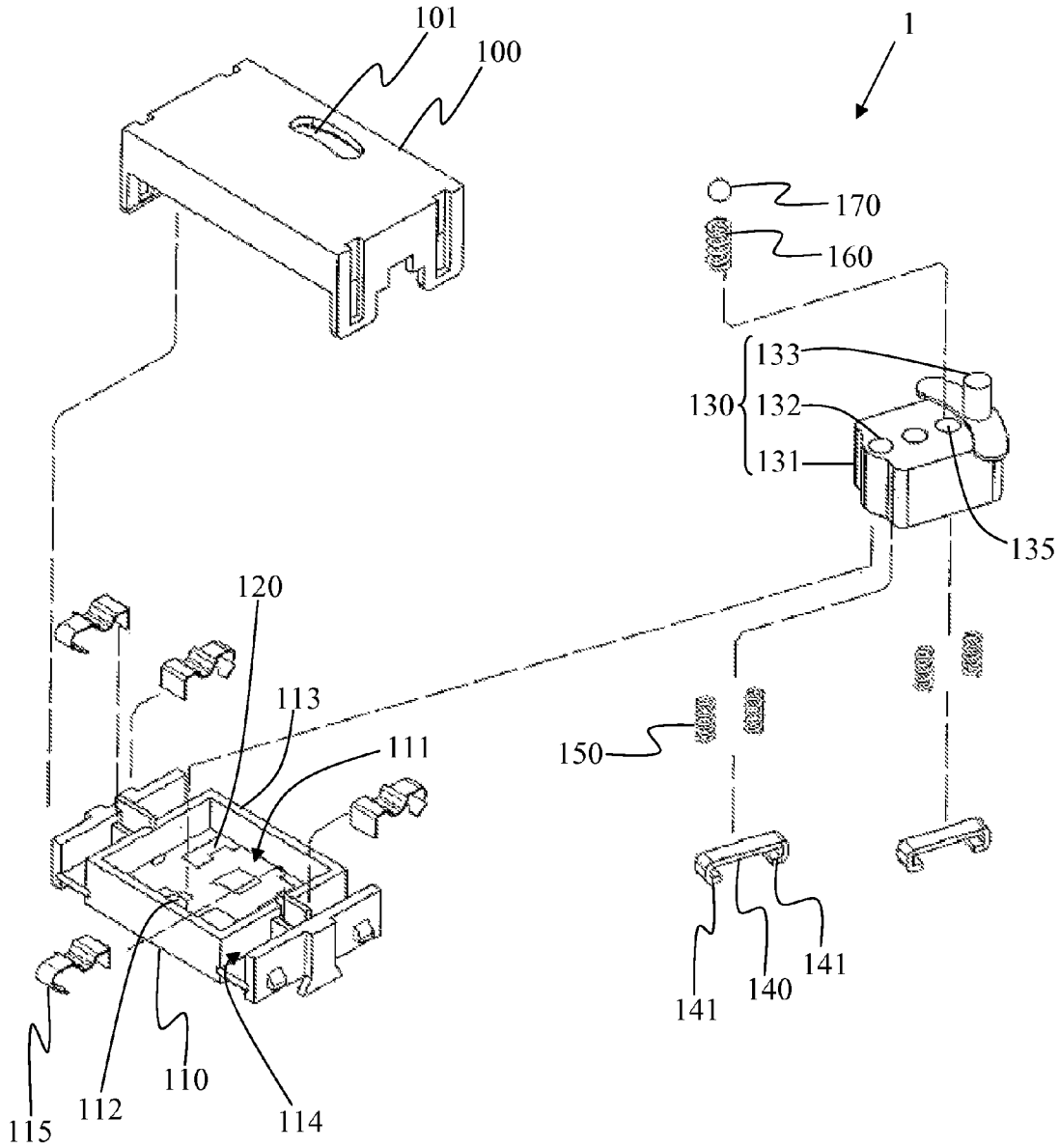
FIG. 3 is an exploded view of the current switching device according to the preferred embodiment of the present invention.
Figure 4:
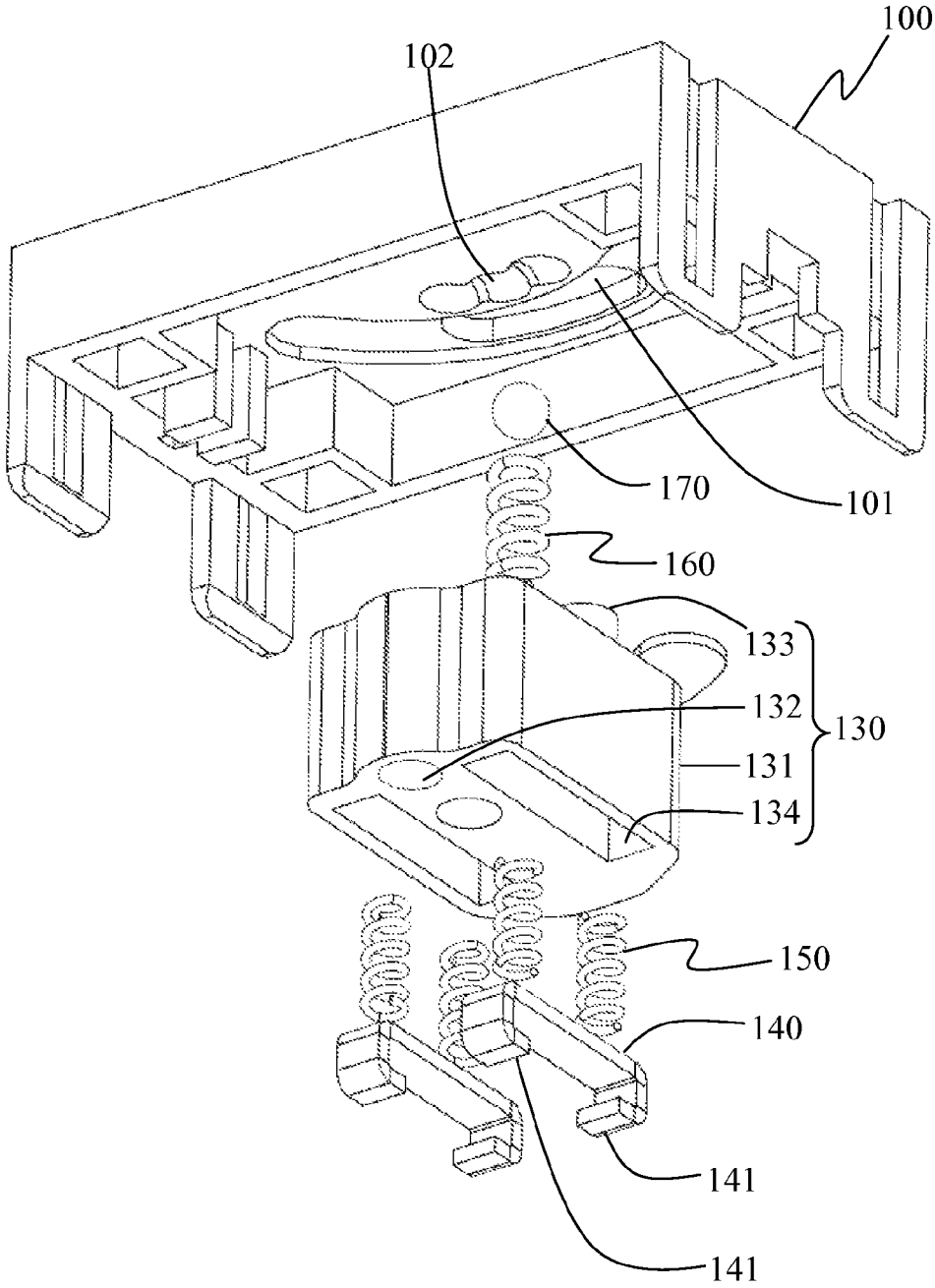
FIG. 4 is an exploded view of some components of the current switching device according to the preferred embodiment of the present invention.

Referring to FIG. 2, FIG. 3 and FIG. 4, wherein FIG. 2 is an assembly drawing of a current switching device according to a preferred embodiment of the present invention, FIG. 3 is an exploded view of the current switching device according to the preferred embodiment of the present invention, and FIG. 4 is an exploded view of some components of the current switching device according to the preferred embodiment of the present invention. The current switching device 1 includes a cover 100, a base 110, a plurality of metal terminals 120, a switching element 130, two contact pieces 140, a plurality of first elastic elements 150, a second elastic element 160, and a slide assisting element 170.

The cover is provided with a curved slot 101.

The base 110 is combined with the cover 100 to form an accommodating space 111. A pivot 112 is disposed on the base 110 and in the accommodating space 111, and a position of the pivot 112 is corresponding to the center of the curved slot 101 of the cover 100. A plurality of side walls 113 are disposed on the surroundings of the base 110, wherein the plurality of side walls 113 can prevent foreign objects from entering the accommodating space 111 and avoid the rotary swing of the switching element 130 being interrupted by the foreign objects. Furthermore, a plurality of conductive carrier fixing slots 114 are disposed on the base 110 and located on the outside of two of the opposite side walls 113. The plurality of conductive carrier fixing slots 114 can be provided for the disposition of a clamping element 115 respectively, wherein the clamping elements 115 can fix the plurality of conductive carriers (not shown in drawings), so as to prevent the plurality of conductive carriers from shedding off.

The plurality of metal terminals 120 is plate-like structure. The plurality of metal terminals 120 is arranged in an asymmetrical shape and buried in the base 110, and each of the plurality of metal terminals 120 exposing one surface to the accommodating space 111. Additionally, part areas of the plurality of the metal terminals 120 are exposed to the plurality of conductive carrier fixing slots 114, when the plurality of conductive carriers are fixed in the plurality of conductive carrier fixing slots 114 respectively, the plurality of conductive carriers can contact with the plurality of the metal terminals 120 and then connect electrically.

The switching element 130 is disposed in the accommodating space 111 and includes: a switching element body 131; an axial hole 132 being disposed on the switching element body 131 and pivotally connected to the pivot 112 of the base 110, so that the switching element body 131 is able to rotate and swing through the pivot 112; a lever 133 being disposed on the surface of the switching element body 131 adjacent to the cover 100, the lever 133 penetrating through the curved slot 101 and being exposed to the outside of the current switching device 1, wherein the lever 133 is able to be pushed for making the switching element body 131 do the rotary swing action; and two accommodating slots 134 being disposed on the surface of the switching element body 131 adjacent to the plurality of metal terminals 120.

The two contact pieces 140 are disposed in the two accommodating slots 134 respectively, and each contact piece 140 contains two contact points 141. All the contact points 141 contact different metal terminals 120, and each contact piece 140 is able to conduct electricity between two metal terminals 120. The contact positions between the two contact pieces 140 and the plurality of metal terminals 120 can be changed by the rotary swing of the switching element 130, so as to switch the current direction.

The plurality of first elastic elements 150 are disposed in the two accommodating slots 134 of the switching element 130 respectively and stopped between the bottom surface of the two accommodating slots 134 and the two contact pieces 140, wherein the resilience of the plurality of first elastic elements 150 can enhance the stability of the contact between the two contact pieces 140 and the plurality of metal terminals 120.

An accommodating hole 135 is disposed on the surface of the switching element body 131 adjacent to the cover 100 for accommodating the second elastic element 160 and the slide assisting element 170. One end of the second elastic element 160 is stopped on the bottom surface of the accommodating hole 135, and another end of the second elastic element 160 contacts with the slide assisting element 170. The slide assisting element 170 is stopped between the second elastic element 160 and an engaging hole 102 disposed on an inner surface of the cover 100. The second elastic element 160 can provide resilience to the slide assisting element 160 for controlling the angle of the rotary swing of the switching element 130.

Figure 5A:
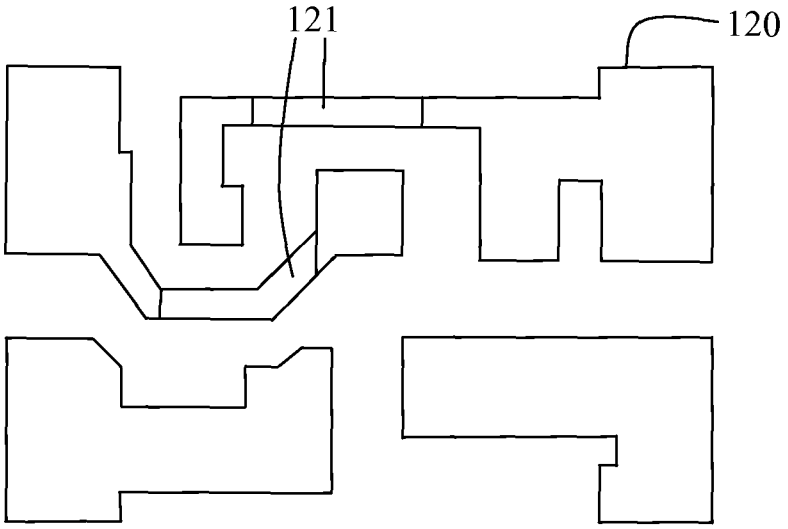
FIG. 5A is a top view of a plurality of metal terminals according to the preferred embodiment of the present invention.
Figure 5B:
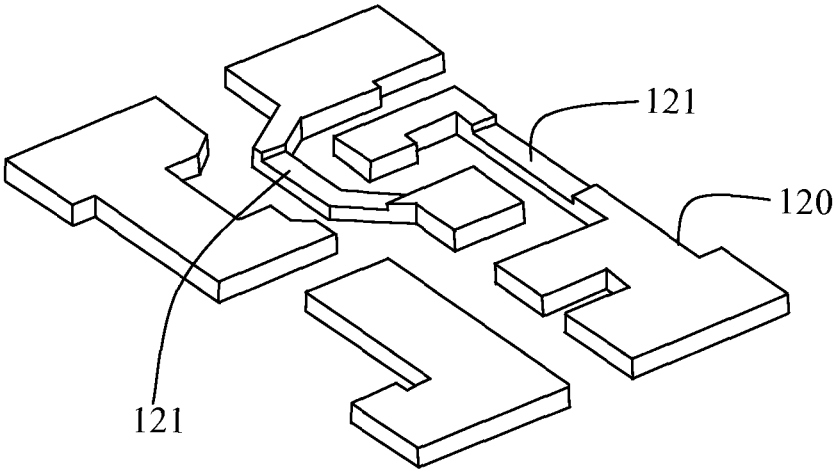
FIG. 5B is a perspective view of the plurality of metal terminals according to the preferred embodiment of the present invention.

Referring to FIG. 5A and FIG. 5B, wherein FIG. 5A is a top view of a plurality of metal terminals according to the preferred embodiment of the present invention, and FIG. 5B is a perspective view of the plurality of metal terminals according to the preferred embodiment of the present invention. The plurality of metal terminals 120 are plate-like structure, and parts of the exposed surface of two metal terminals 120 are formed into sunken areas 121. When the two metal terminals 120 are buried in the base 110, the sunken areas 121 are covered by the material of the base 110 and then hidden, so as to increase the stability of the integration between the metal terminals 120 and the base 110. However, in practice, the number and the location of the sunken areas 121 can be revised according to different demands.

Figure 6A:
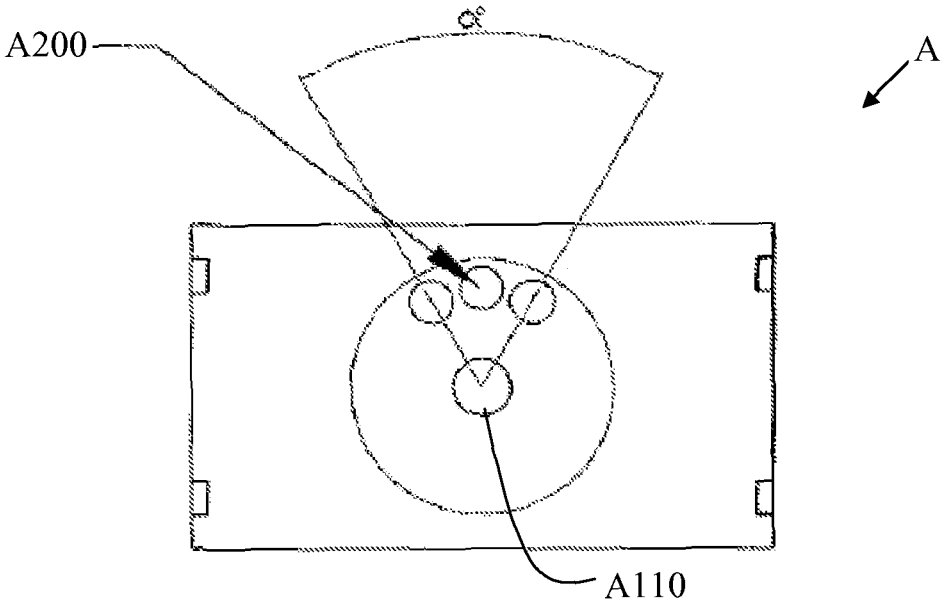
FIG. 6A is a schematic diagram of a switching manner of the conventional current switching device.
Figure 6B:
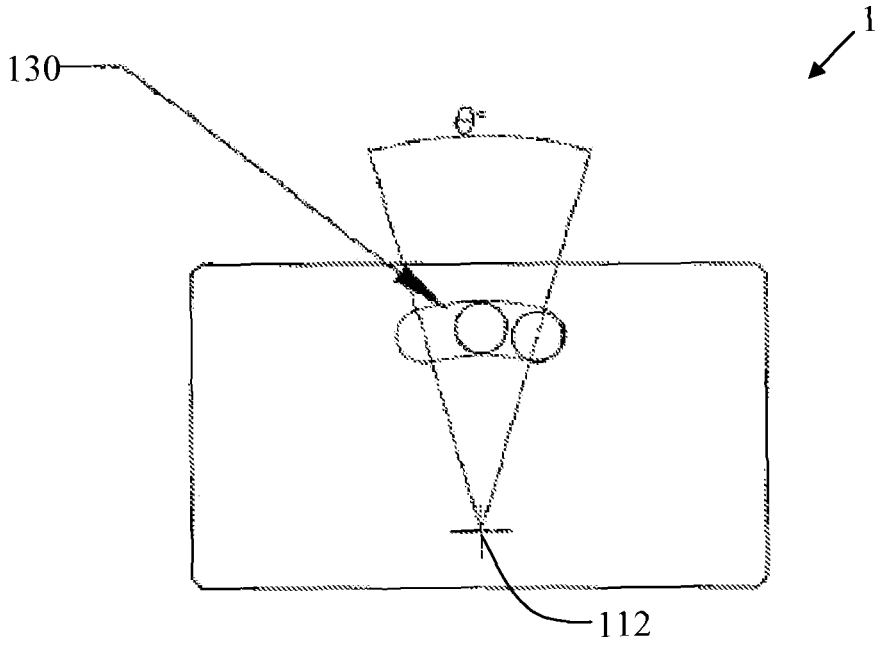
FIG. 6B is a schematic diagram of a switching manner of the current switching device according to the preferred embodiment of the present invention.

Referring to FIG. 6A and FIG. 6B, wherein FIG. 6A is a schematic diagram of a switching manner of the conventional current switching device, and FIG. 6B is a schematic diagram of a switching manner of the current switching device according to the preferred embodiment of the present invention. As shown in FIG. 6A, in the conventional current switching device A, the pivot A110 of the switching element A200 is disposed on the center of the conventional current switching device A, thus the center of the conventional current switching device A is as the rotating shaft for the rotation of the switching element A200. As shown in FIG. 6B, in the current switching device 1 of the present invention, the pivot 112 of the switching element 130 is disposed on one lateral of the current switching device 1, thus the switching element 130 can do a rotary swing different from the rotation manner of the conventional technique.

Figure 7:
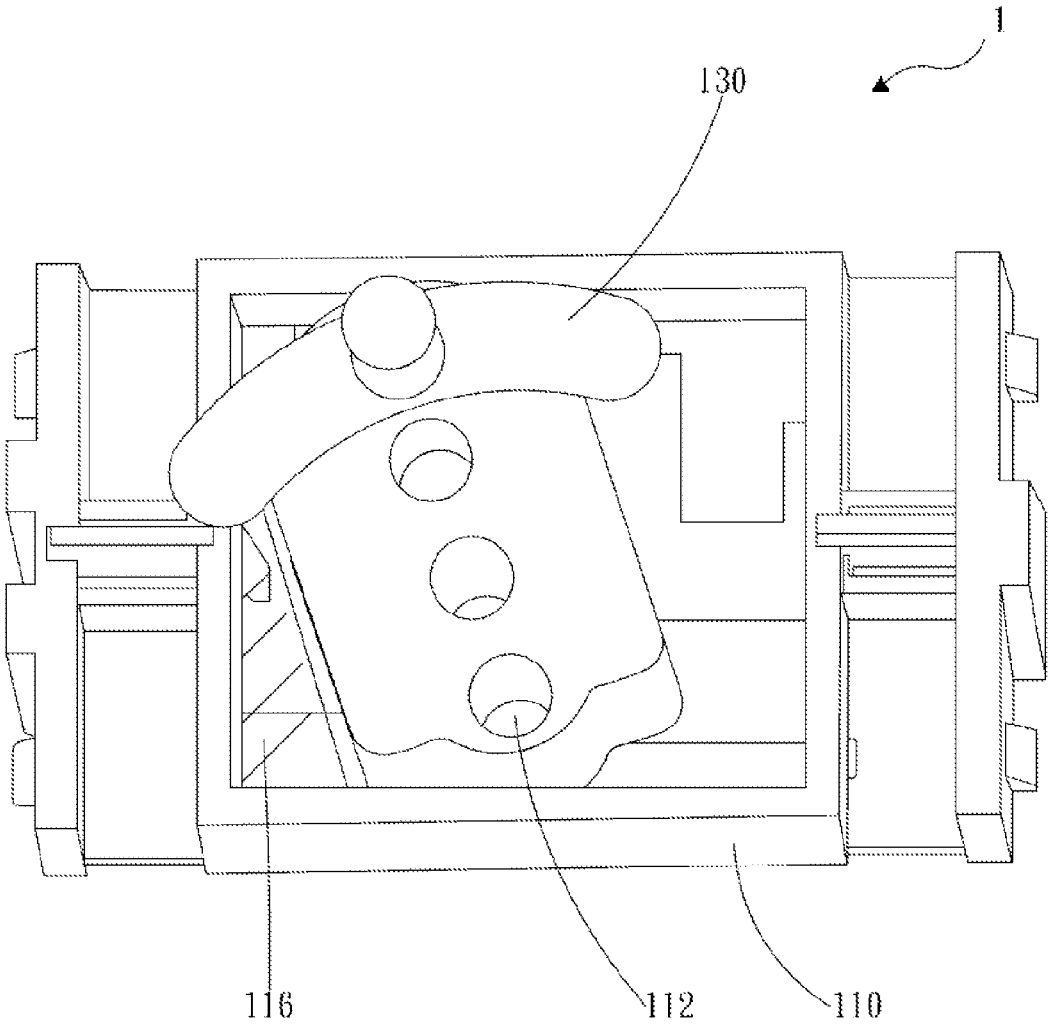
FIG. 7 is a schematic diagram of a space allocation of the base according to the preferred embodiment of the present invention.

Referring to FIG. 7, which is a schematic diagram of a space allocation of the base according to the preferred embodiment of the present invention. Owing to the pivot 112 of the switching element 130 is disposed on one lateral of the current switching device 1, and the switching element 130 can do a rotary swing with a specific angle, there still has extra space 116 to be utilized between the base 110 and the switching element 130 when the switching element 130 do the rotary swing to the limit of one direction. The extra space 116 can be utilized for the dust-proof design, and it also can be utilized for reducing the overall volume, so as to decrease the material cost.

Figure 8A:
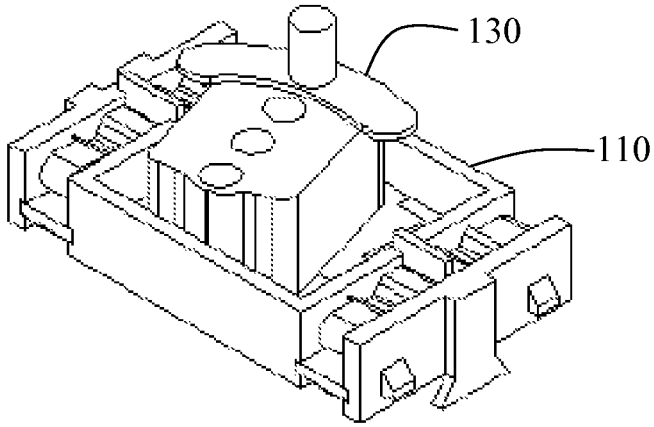
FIG. 8A is a perspective view of a first switching direction according to the preferred embodiment of the present invention.
Figure 8B:
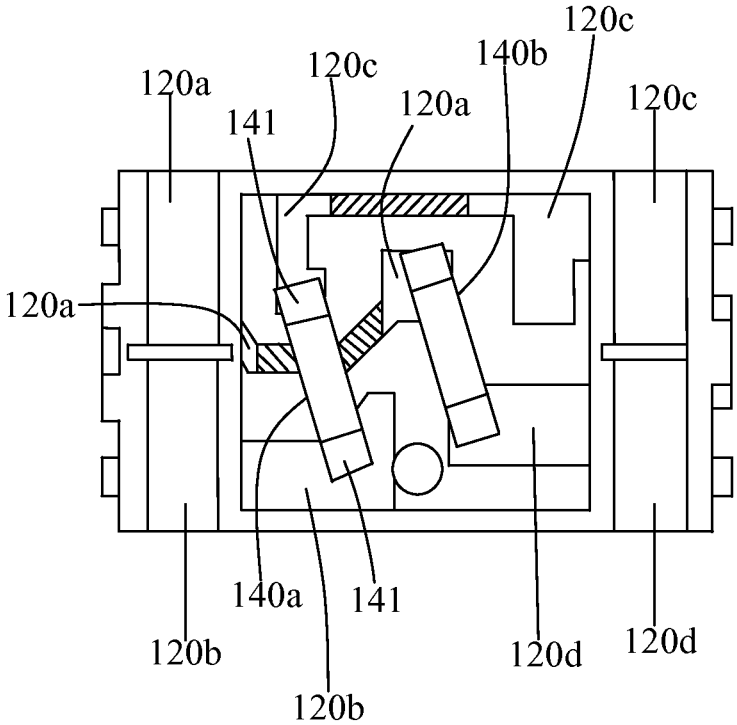
FIG. 8B is a top view of the first switching direction according to the preferred embodiment of the present invention.
Figure 8C:
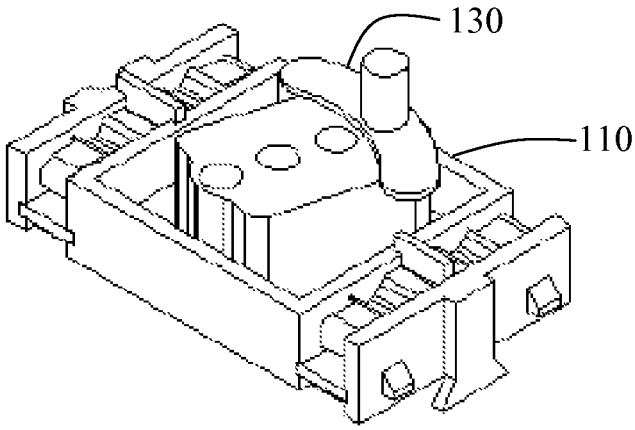
FIG. 8C is a perspective view of a second switching direction according to the preferred embodiment of the present invention.
Figure 8D:
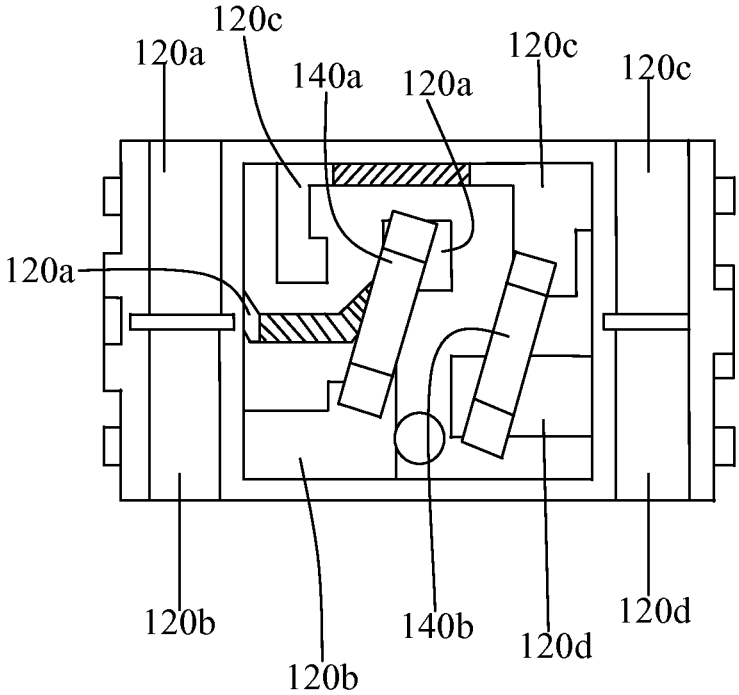
FIG. 8D is a top view of the second switching direction according to the preferred embodiment of the present invention.

Referring to FIG. 8A to FIG. 8D, wherein FIG. 8A is a perspective view of a first switching direction according to the preferred embodiment of the present invention, FIG. 8B is a top view of the first switching direction according to the preferred embodiment of the present invention, FIG. 8C is a perspective view of a second switching direction according to the preferred embodiment of the present invention, FIG. 8D is a top view of the second switching direction according to the preferred embodiment of the present invention. As shown in FIG. 8A and FIG. 8B, when the switching element 130 rotates counterclockwise to the limit, two contact points 141 of a left contact piece 140*a* contact the extended surfaces of a top right metal terminal 120*c* and a lower left metal terminal 120*b* respectively, so as to make the top right metal terminal 120*c* and the lower left metal terminal 120*b* electrically connect to each other; oppositely, a right contact piece 140*b* makes a top left metal terminal 120*a* and a lower right metal terminal 120*d* electrically connect to each other. As shown in FIG. 8C and FIG. 8D, when the switching element 130 rotates clockwise to the limit, the left contact piece 140*a* makes the top left metal terminal 120*a* and a lower left metal terminal 120*b* electrically connect to each other, and the right contact piece 140*b* makes the top right metal terminal 120*c* and the lower right metal terminal 120*d* electrically connect to each other. It can be seen from this that there are two different electrical connection manners between the plural metal terminals 120 when the switching element 130 rotates to two terminal ends, so as to switch current direction. In practical applications, the current switching device 1 is not limited to have two switching directions merely, that is to say the number of switching level and the switching direction can be increased or decreased according to different application purposes, and then increase the elasticity of the application.

Figure 9:
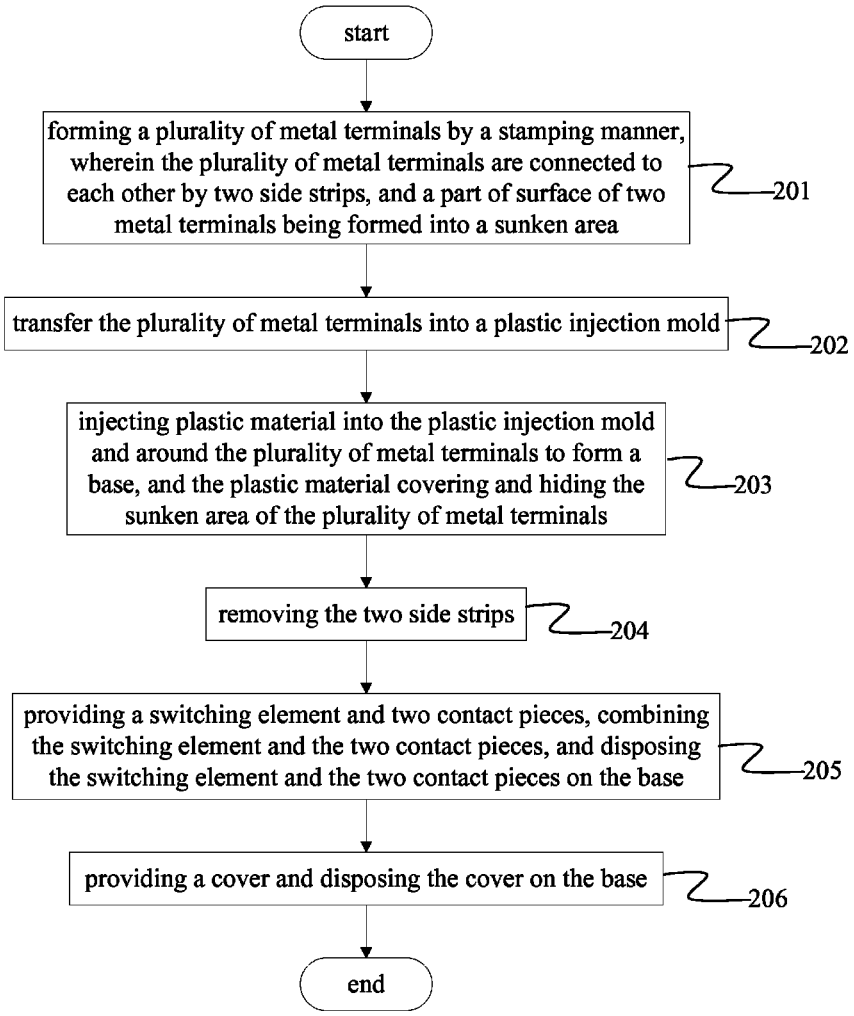
FIG. 9 is a flow chart of a method for manufacturing the current switching device according to the preferred embodiment of the present invention.

Referring to FIG. 9, which is a flow chart of a method for manufacturing the current switching device according to the preferred embodiment of the present invention. The method includes the steps of: (step 201) forming a plurality of metal terminals by a stamping manner, wherein the plurality of metal terminals are connected to each other by two side strips, and a part of surface of two metal terminals being formed into a sunken area; (step 202) transfer the plurality of metal terminals into a plastic injection mold; (step 203) injecting plastic material into the plastic injection mold and around the plurality of metal terminals to form a base, and the plastic material covering and hiding the sunken area of the plurality of metal terminals; (step 204) removing the two side strips; (step 205) providing a switching element and two contact pieces, combining the switching element and the two contact pieces, and disposing the switching element and the two contact pieces on the base; and (step 206) providing a cover and disposing the cover on the base.

In the above step 205, the plurality of clamping elements 115, the plurality of first elastic elements 150, the second elastic element 160, and the slide assisting element 170 can be further provided simultaneously, and then dispose the plurality of clamping elements 115, the plurality of first elastic elements 150, the second elastic element 160, and the slide assisting element 170 on the switching element 130, so as to fabricate the complete current switching device 1.

Figure 10:
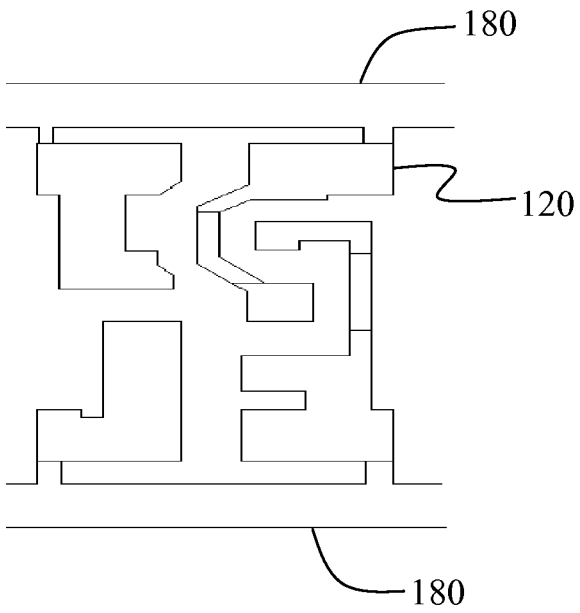
FIG. 10 is a schematic diagram of a connection manner between the plurality of metal terminals and two side strips according to the preferred embodiment of the present invention.

Referring to FIG. 10, which is a schematic diagram of a connection manner between the plurality of metal terminals and two side strips according to the preferred embodiment of the present invention. The two side strips 180 are disposed on two opposite sides of the plural metal terminals 120, and each side strip 180 connects with adjacent metal terminals 120. Such a design type includes the following advantages: (1) the confusion between the similar metal terminals 120 can be avoided, so as to manage the metal terminals 120 conveniently; (2) the plurality of metal terminals 120 can be formed by the stamping manner at the same time, so as to reduce labor hours; and (3) the plurality of metal terminals 120 can be taken out from the mold conveniently.

Figure 11:
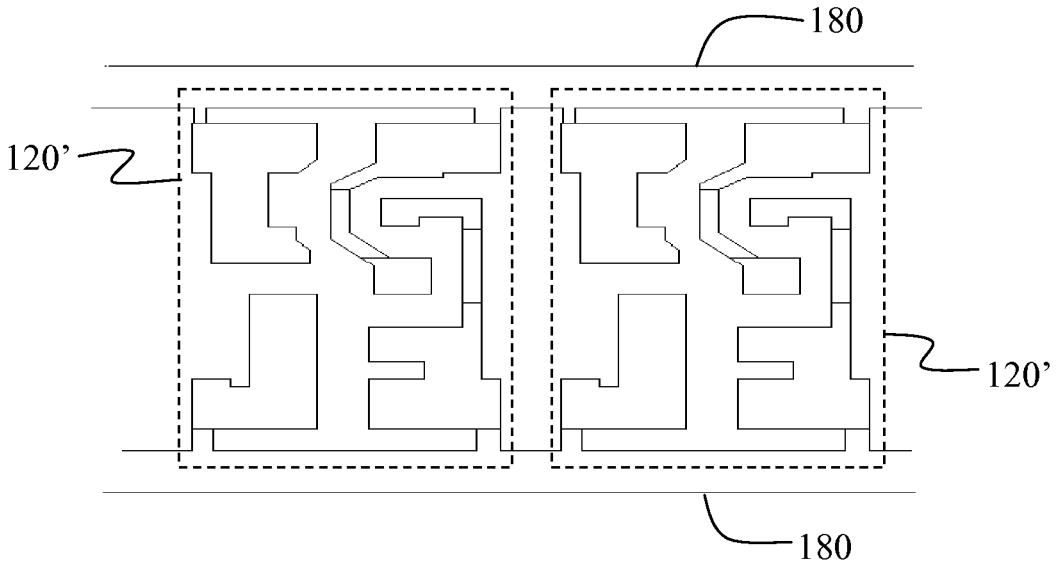
FIG. 11 is a schematic diagram of a connection manner between two metal terminal groups and two side strips.

Furthermore, the aforementioned manufacturing method only discloses the method for burying the plurality of metal terminals 120 (hereinafter a metal terminal group 120') in the base 110 of the current switching device 1, however, if the manufacturing method of the present invention is extended, several metal terminal groups 120' and the bases 110 can be formed by the injection molding manner simultaneously or sequentially. The approach is to form a plurality of metal terminal groups 120' simultaneously by the stamping manner in step 201, and all the plurality of metal terminal groups 120' are connected with each other by two side strips 180. Referring to FIG. 11, which is a schematic diagram of a connection manner between two metal terminal groups and two side strips. Although this figure only illustrates two metal terminal groups 120', in practical applications, the number of the metal terminal groups 120' can be increased according to requirement. Subsequently, transfer the metal terminal groups 120' in turn into the plastic injection mold, and inject plastic material into the plastic injection mold and around the metal terminal groups 120'. After the base being forming, cut off the two side strips 180 and separate the two side strips 180 from the metal terminal groups 120'. After repeating the above actions, the fabrication of plural metal terminal groups 120' combined with their base 110 is accomplished.

By the detailed description of the overall structure and technical content of the present invention, the following advantages of the present invention can be derived:

The switching element is designed to switch current direction by the swing manner in the present invention, which can save the inner space of the current switching device, wherein the extra space can be utilized for the dust-proof design, and it also can be utilized for reducing the overall volume, so as to decrease the material cost.

The base of the present invention is formed by injecting the plastic material which cover the surroundings of the metal terminals and the sunken areas, and the extent of integration between the metal terminals and the base can be increased, therefore the metal terminals can not easily get loose from the base, so as to elevate the overall stability.

The arrange manner of the plurality of metal terminals of the present invention is the form of non-circular symmetry, such a way can meet different design requirements, thus the elasticity of the applications can be raised.

It should be understood that the embodiments of the present invention described herein are merely illustrative of the technical concepts and features of the present invention and are not meant to limit the scope of the invention. Those skilled in the art, after reading the present disclosure, will know how to practice the invention. Various variations or modifications can be made without departing from the spirit of the invention. All such equivalent variations and modifications are intended to be included within the scope of the invention.

As a result of continued thinking about the invention and modifications, the inventors finally work out the designs of the present invention that has many advantages as described above. The present invention meets the requirements for an invention patent, and the application for a patent is duly filed accordingly. It is expected that the invention could be examined at an early date and granted so as to protect the rights of the inventors.

What is claimed is:

1. A current switching device comprising:

a cover being provided with a curved slot;

a base being combined with the cover to form an accommodating space, wherein a pivot is disposed on one side of the base and corresponding to the center of the curved slot of the cover;

a plurality of metal terminals with plate-like structure being arranged in an asymmetrical shape and buried in the base, and each of the plurality of metal terminals has at least one surface exposed to the accommodating space, wherein at least one of the metal terminals has a sunken area formed on the surface of the metal terminals, and the sunken area is covered by part of the base for increasing the stability of the connection between the metal terminal and the base;

a switching element disposed in the accommodating space comprises:

a switching element body;

an axial hole disposed on the switching element body and pivotally connected to the pivot of the base, so that the switching element body is able to rotate and swing through the pivot;

a lever disposed on the other side of the switching element body opposite to the axial hole and passing through the curved slot to expose to the outside of the current switching device, wherein the lever is able to be pushed for operating the rotary swing of the switching element body; and at least two accommodating slots disposed on the surface of the switching element body adjacent to the plurality of metal terminals; and at least two contact pieces disposed in the two accommodating slots respectively, and each contact piece comprising at least two contact points, wherein all the contact points contact different metal terminals, and each contact piece being able to conduct electricity between two metal terminals, the contact positions between the two contact pieces and the plurality of metal terminals being able to be changed by the rotary swing of the switching element, so as to switch the current direction;

when the switching element rotates in the accommodating space and swings to touch the edge of the base, an extra space between the base and the switching element would remain in the accommodating space for designing dust-proof structure or minimizing the volume of the base so as to reduce material cost.

2. The current switching device according to claim 1, further comprising a plurality of side walls disposed on the surroundings of the base, wherein the plurality of side walls can prevent foreign objects from entering the accommodating space and avoid the rotary swing of the switching element being interrupted by the foreign objects.

3. The current switching device according to claim 1, further comprising a plurality of conductive carrier fixing slots disposed on the base, and parts of areas of the plurality of metal terminals being exposed to the plurality of conductive carrier fixing slots respectively, wherein a plurality of conductive carriers can contact the plurality of metal terminals respectively for conducting electricity when the plurality of conductive carriers are fixed in the plurality of conductive carrier fixing slots.

4. The current switching device according to claim 3, further comprising a plurality of clamping elements disposed in the plurality of conductive carrier fixing slots for fixing the plurality of conductive carriers, so as to prevent the plurality of conductive carriers from shedding off.

5. The current switching device according to claim 1, further comprising a plurality of first elastic elements disposed in the two accommodating slots of the switching element respectively and stopped between the bottom surface of the two accommodating slots and the two contact pieces, wherein the resilience of the plurality of first elastic elements can enhance the stability of the contact between the two contact pieces and the plurality of metal terminals.

6. The current switching device according to claim 1, further comprising an accommodating hole disposed on the surface of the switching element body adjacent to the cover for accommodating a second elastic element and a slide assisting element, wherein one end of the second elastic element is stopped on the bottom surface of the accommodating hole, and another end of the second elastic element contacting with the slide assisting element, and wherein the slide assisting element is stopped between the second elastic element and an engaging hole disposed on an inner surface of the cover, the second elastic element providing resilience to the slide assisting element for controlling the angle of the rotary swing of the switching element.

* * * * *